United States Patent [19]

Williamson

[11] 4,197,622

[45] Apr. 15, 1980

[54] WET TOW CRIMPING PROCESS

[75] Inventor: Thomas D. Williamson, Lugoff, S.C.

[73] Assignee: E. I. Du Pont de Nemours and Company, Wilmington, Del.

[21] Appl. No.: 934,614

[22] Filed: Aug. 17, 1978

[51] Int. Cl.[2] ..... D02G 1/12

[52] U.S. Cl. ..... 28/267

[58] Field of Search ..... 28/221, 248, 265, 267, 28/268

[56] References Cited

U.S. PATENT DOCUMENTS

| | | | |
|---|---|---|---|
| 3,725,523 | 4/1973 | Bowen | 28/265 X |
| 3,916,651 | 11/1975 | Carruthers | 28/267 X |
| 3,965,548 | 6/1976 | James, II et al. | 28/267 X |

*Primary Examiner*—Robert Mackey

[57] ABSTRACT

Utilization of finish and recovery of materials for control of pollution are improved in a tow crimping process wherein an advancing tow of fibers which have been processed in an aqueous bath or series of aqueous baths is uniformly compressed in a confined space under a nip pressure of 600–1,000 lbs./in. to exude solvent-containing water from the tow, the exudate being returned to the last aqueous bath, a predetermined amount of finish is applied to the tow, the fibers are crimped in a stuffing box crimper whereby some of the finish and a small amount of residual moisture are exuded from the tow, the exudate is recovered and removed to a storage container, the exudate is re-applied to the tow at a rate corresponding to the rate of exudation and the crimped tow is collected and then dried.

4 Claims, 1 Drawing Figure

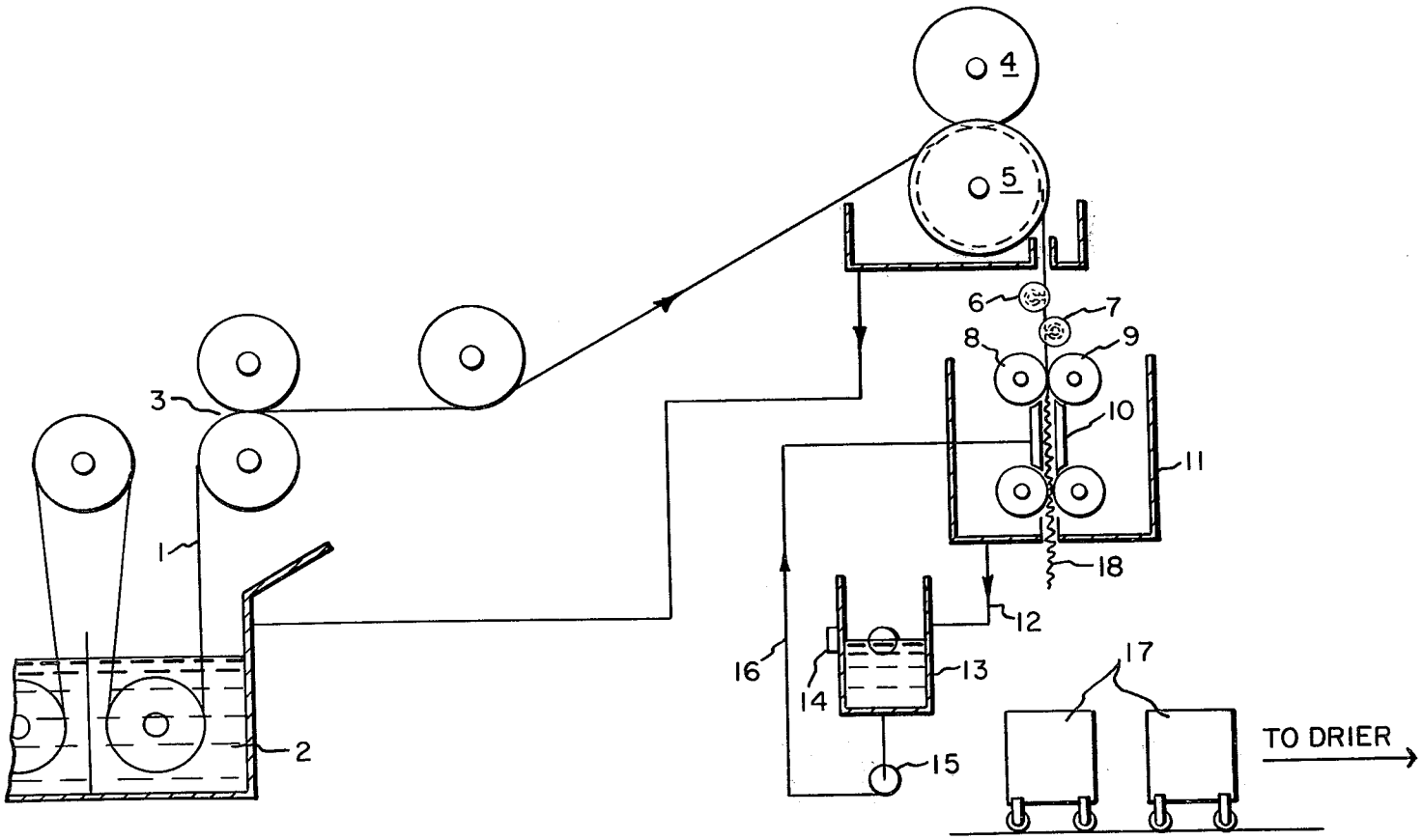
TO DRIER
1
2
3
4
5
6
7
8
9
10
11
12
13
14
15
16
17
18

WET TOW CRIMPING PROCESS

BACKGROUND OF THE INVENTION

This invention relates to an improved process for crimping tows of wet fibers. The process is particularly useful in the crimping of wet tows comprised of acrylic fibers.

In the crimping of tows of wet fibers following processing in one or more aqueous baths, it is customary to remove some of the water from the tow by squeezing the tow under moderate pressure, e.g., 35 lbs./in., whereby the moisture content of the tow is reduced to 60 to 90% by weight. Finish is then applied to the tow and the tow is crimped, e.g., in a stuffing box crimper whereby finish and solvent-containing water are exuded from the tow. Although the exudate consists mostly of water derived from the finish and the aqueous baths, it cannot be simply discarded because of pollution considerations. The exudate cannot be returned to the bath for ultimate recovery of solvent because the finish causes excessive foaming in the bath. Recovery of solvent from the exudate is difficult because breakdown of finish components cause fouling of the distillation equipment used in solvent recovery. If the exudate is reapplied to the tow in the stuffing box, the crimp tow contains excessive water and solvent. If such a tow is lagged in cans before drying, as is the usual practice, the excessive moisture tends to separate toward the bottom of the can. When tow from such cans is passed through a dryer, uneven drying results causing non-uniformities in the tow. It would be highly desirable to avoid both the necessity of recovering solvent from the exudate and the loss of finish.

The present invention provides an improved process for crimping tows of wet fibers whereby essentially all of the applied finish is retained on the fibers. Consequently, no pollution with respect to finish occurs.

This invention provides an improved process for crimping an advancing tow of fibers which have been processed in an aqueous bath or series of aqueous baths wherein the tow is uniformly compressed in a confined space under a nip pressure of 600–1,000 lbs./in. to exude solvent-containing water from the tow, the exudate being returned to the last aqueous bath, a predetermined amount of finish is applied to the tow, the fibers are crimped in a stuffing-box crimper whereby some of the finish and a small amount of residual moisture are exuded from the tow, the exudate is recovered and removed to a storage container, the exudate is reapplied to the tow in the stuffing box at a rate corresponding to the rate of expression and the crimped tow is collected and then dried. Preferably, the tow is comprised of acrylic fibers and the tow is compressed to contain 25–35%, preferably 30–35% by weight water. Most preferably, the nip pressure is about 800 lbs./in.

In conventional processes wherein a tow of fibers is treated in an aqueous bath or a series of aqueous baths, finish is usually applied to the tow immediately upon removal of the tow from squeeze rolls following the last aqueous bath. An example of such tow processing occurs in the wet or dry spinning of acrylic fibers wherein the freshly spun fibers are extracted to remove spinning solvent and drawn while passing through a series of hot aqueous baths with countercurrent flow of the bath liquid from one bath to the preceding bath. The liquid from the first bath is removed for recovery of the spinning solvent, usually by distillation. The squeeze rolls are operated under a moderate pressure, e.g., 35 lbs./in. whereby the water content of the tow is reduced to about 60 to 90% by weight.

According to the present invention, the finish is not applied to the tow leaving the squeeze rolls but rather the tow is passed to precision squeeze rolls preferably comprised of a smooth flat roll and a matching flanged roll designed to provide a positive nip area through which the tow passes. These rolls should be capable of exerting a force in the range of 600–1,000 lbs./in. Solvent-containing water which is squeezed out of the tow by these rolls is returned to the last aqueous bath for eventual recovery of the solvent. These rolls can replace the pull rolls normally used to feed a stuffing-box crimper. Finish is applied to the tow and the tow is fed into a stuffing-box crimper where some of the finish and a small additional amount of solvent-containing water is exuded from the tow. This exudate is collected and re-applied to the tow at the same rate as it is exuded. The crimped tow is collected and dried. Tows crimped according to the process of the invention have a lower content of moisture than prior art tows and thus can be dried more easily.

Referring to the drawing, tow 1 coming from aqueous bath 2 is passed through squeeze rolls 3 and then to precision squeeze rolls consisting of flat roll 4 and flanged roll 5 wherein a nip pressure of 600–1,000 lbs./in. is applied and the water content of the tow is reduced to 30 to 35% by weight and the solvent content of the tow is reduced to 2.0 to 2.5% by weight. A predetermined amount of finish is applied to both sides of tow 1 by applicator spools 6 and 7 and the tow 1 is passed between crimper rolls 8 and 9 into stuffing-box crimper 10 adjusted to give the desired amount of crimp. Finish and the small amount of solvent-containing water exuded from tow 1 by crimper rolls 8 and 9 is collected in pan 11 and passed through pipe 12 to storage tank 13 fitted with a level control 14. Storage tank 13 is filled with finish adjusted to about 12% nonvolatiles content up to level control 14 at the beginning of operations. In response to level control 14, recovered finish is removed from storage tank 13 by pump 15 through pipe 16 to the stuffing box of crimper 10 where recovered finish is re-applied to the tow. Crimped tow 18 may be collected in cans 17 for eventual drying.

The process of the present invention is applicable to tows of fibers having deniers of 0.5 to 20 (0.056 to 2.22 tex). Tows having a total denier of 200,000 to 500,000 or more (22,000 to 55,600 tex) can be processed depending on the size of the crimper. Acrylic tows containing water and a small amount of spinning solvent such as N,N-dimethylformamide (DMF) or N,N-dimethylacetamide (DMAc) are preferred.

EXAMPLE

An acrylic polymer containing 93.6% by weight acrylonitrile, 6.0% by weight methyl acrylate and 0.4% by weight sodium styrenesulfonate and having an intrinsic viscosity of 1.5 is dry spun conventionally, residual spinning solvent is extracted and the fibers are drawn while passing through nine consecutive hot water tanks. Fresh hot water is fed to the last tank and overflow from each tank is passed to the previous tank, the overflow from the first tank going to solvent recovery. The total draw is 4.52X and when dry, the fibers have a denier of 6 (0.67 tex), the tow has a denier of 470,000 (52,000 tex).

A. In accordance with prior art procedures, on emerging from the last tank the tow is passed between two squeeze rolls under a pressure of about 35 lbs./in., the exudate being returned to the last tank. Finish is applied to the tow as the tow is pulled across a roll revolving in a pool of textile finish. The tow is advanced by means of pull rolls to a stuffing-box crimper. The pressure on the crimping rolls is set to give the desired amount of crimp (5–12 crimps/in.) and 9% liquor based on the dry weight of the tow is exuded. This liquor contains 1–2% by weight solvent (DMF) and 1–2% by weight finish. This corresponds to about 50% by weight of the finish applied. The presence of finish makes the exuded liquor unsuitable for return to solvent recovery because the finish fouls the solvent distillation column. Consequently, the liquid must be specially processed to avoid pollution. The loss of finish is not only wasteful but makes control of the finish content of tow more difficult in that an empirical excess of finish must be applied to the tow in order to arrive at a desired amount of finish on the tow after crimping. Unfortunately, a change in crimping conditions requires a change in the amount of excess finish applied.

If the exuded liquor is reapplied to the tow and the tow is immediately dried, processing is satisfactory except for the additional load on the drier caused by the additional water. If the tow is collected in cans and lagged for 12–24 hours as is normal, the additional water separates from the tow towards the bottom of the can causing uneven drying and unacceptable nonuniformity in the tow.

B. In accordance with the present invention, on emerging from the last tank the tow is passed through two squeeze rolls as before using a nip pressure of about 35 lb./in. with the exudate being returned to the last tank. Only water is applied from the usual finish roll. The tow is then passed between a smooth flat roll and a flanged roll which together form a rectangular nip into which the tow is uniformly and severely squeezed using a nip pressure of about 800 lbs./in. The exuded liquor is returned to the last tank. Finish is applied to both sides of the ribbon-like tow issuing from the squeeze rolls by passing the tow in contact with flanged spools each having a horizontal slot along the line of ribbon contact through which an aqueous textile finish is metered onto the tow. The tow is then passed to a stuffing-box crimper. The crimper rolls squeeze out an amount of finish and liquor amounting to about 2% based on the weight of the dry tow. This exudate is directed to a tank equipped with a level controller of conventional design. A pump driven in response to signals from the level controller removes exudate from the tank at a rate corresponding to the rate of exudate collection and injects it into the stuffing box. The crimped tow has a finish content corresponding to that applied by the slotted, flanged spools. Thus, finish loss is avoided and there is no solvent to collect at this stage for recovery.

Comparison of the crimped tows from parts A and B of this example shows lower water content (32 vs. 41% on fiber) in the tow of part B which means reduced drier load and less solvent loss, benefiting both process economics and ecology. Subtle but potentially important process advantages are expected in the product that can be dried with lower heat input and greater uniformity. Uniformity improvement is expected due to minimized settling of water to the lower levels of fiber in crimp-tow cans on lagging. Rope dewatered to the extent provided for in this process shows little or no tendency to develop top-to-bottom gradation in water (and finish) content as lagged in cans.

The composition of the tow can markedly affect its ability to retain moisture under a given roll-nip pressure. A more hydrophilic filament such as, for example, one comprising about 4% units derived from sodium styrene sulfonate typically will contain about 60% water after crimping in the manner which leads to 41% water in the foregoing exemplified comparison. It is adequate in processing such tows according to this invention, to reduce the water content to about 55% before finish addition. The amount of exudate which will be removed by the crimper from such a tow, after addition of finish, will not exceed the amount that can be accommodated as reapplied to the tow in the crimper.

I claim:

1. A process for crimping an advancing tow of fibers which have been processed in at least one aqueous bath by the steps of uniformly compressing the tow in a confined space under a nip pressure of 600–1,000 lbs/in (107–178 kg/cm) to exude solvent-containing water from the tow, returning this exudate to the last aqueous bath, applying a predetermined amount of finish to the tow, crimping the fibers in a stuffing box crimper whereby some of the finish and a small amount of residual moisture are exuded from the tow, recovering the the moisture containing finish and removing it to a storage container, re-applying the recovered finish to the tow in the stuffing box at a rate corresponding to the rate of expression and collecting and drying the crimped tow.

2. The process of claim 1 wherein the tow is comprised of acrylic fibers.

3. The process of claim 2 wherein the tow is compressed to contain 30–35% by weight water.

4. The process of claim 2 wherein the nip pressure is about 800 lbs./in.

* * * * *